United States Patent [19]

Cumings et al.

[11] 4,004,893

[45] Jan. 25, 1977

[54] METHODS FOR MOLDING COAL AND LIKE MATERIAL

[75] Inventors: Francis J. Cumings, Windham, N.H.; Victor Kevorkian, Belle Mead, N.J.

[73] Assignee: Ingersoll-Rand Research, Inc., Princeton, N.J.

[22] Filed: Jan. 30, 1976

[21] Appl. No.: 653,699

Related U.S. Application Data

[63] Continuation of Ser. No. 529,023, Dec. 3, 1974, abandoned.

[52] U.S. Cl. ..... 44/10 H; 44/13

[51] Int. Cl.[2] ..... C10L 5/00; C10L 5/22

[58] Field of Search ..... 44/10 R, 10 H, 13

[56] References Cited

UNITED STATES PATENTS

| | | | |
|---|---|---|---|
| 3,213,169 | 10/1965 | Kardaun et al. | 44/10 R |
| 3,674,449 | 7/1972 | Schmalfeld et al. | 44/10 R |
| 3,856,481 | 12/1974 | Grechanichenko et al. | 44/10 H |

*Primary Examiner*—Carl F. Dees
*Attorney, Agent, or Firm*—Bernard J. Murphy

[57] ABSTRACT

Method for molding coal and like material, wherein the material is converted solely by heat to plastic-like condition and then molded.

2 Claims, 1 Drawing Figure

METHODS FOR MOLDING COAL AND LIKE MATERIAL

Figure 1:
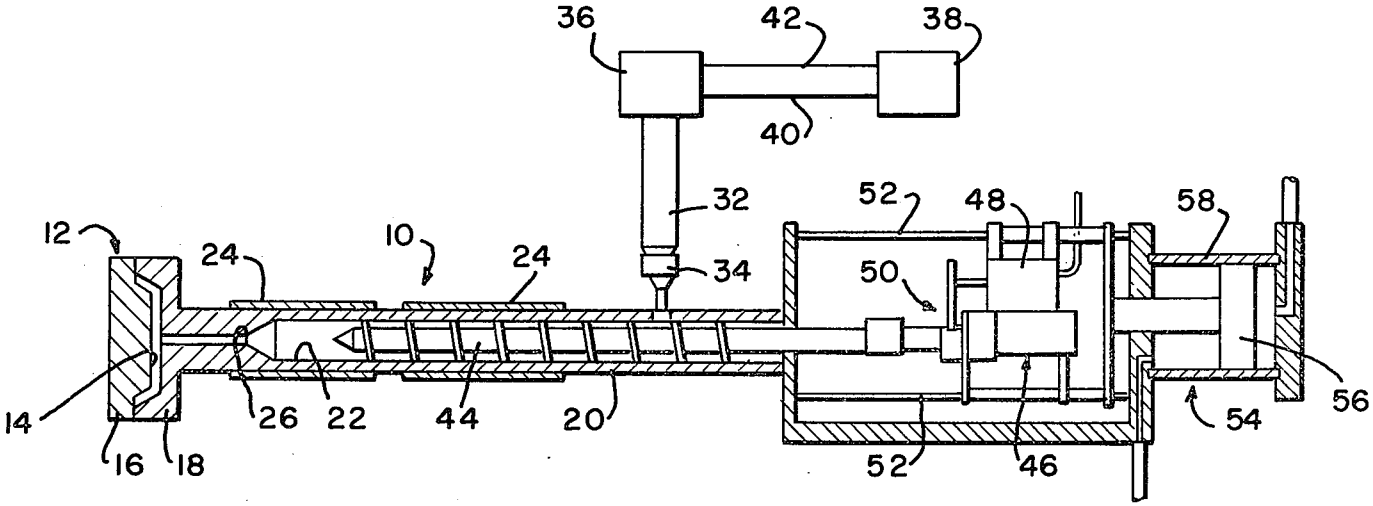

This is a continuation of application Ser. No. 529,023 filed Dec. 3,1974, now abandoned.

The present invention relates to the molding of coal and like material and more particularly to the provision of new and improved methods particularly adapted for the molding of coal and like material. As will be understood, the term "coal and like material" is employed herein to include coal, coke, coal tar, asphalt, bitumin, kerogen, and mixtures thereof, all of the mentioned materials being hydrocarbon materials in solid state at room temperature and naturally occuring or readily derivable from naturally occuring materials by simple physical processes.

The principal object of the present invention is to provide new and improved methods particularly adapted for the molding of coal and like material.

Another object of the invention is to provide new and improved methods of the type set forth particularly adapted whereby coal and like material may be converted from solid to plastic-like condition solely by the application of heat and without the necessity for additives.

Other objects and advantages of the invention will be apparent from the following description taken in connection with the accompanying drawing wherein, as will be understood, the preferred form of the invention has been shown for the purposes of illustration only.

In accordance with the invention, coal and like material may be molded by a method comprising the steps of providing the material in a solid form capable of being converted by heating to plastic-like condition, converting such provided material to plastic-like condition by heating the provided material to a temperature sufficiently great to effect such conversion, and molding the material in such plastic-like condition to desired configuration. Referring to the drawing:

FIG. 1 is a view schematically depicting one embodiment of apparatus for the practice of the methods of the invention.

Referring more particularly to the drawing, FIG. 1 illustrates a plasticizing-and-feeding apparatus, designated generally as 10, which is operatively associated with the mold 12 of a conventional molding machine for feeding coal and like material in plastic-like condition into the mold cavity 14. The mold 12 is of conventional two-part construction and includes the usual mold halves or sections 16,18 cooperative to form the mold cavity 14 of the configuration of the article to be molded therein. The mold sections 16,18 are in the conventional manner relatively cyclically driven between mold closed positions wherein, as illustrated, they are in abutment with one another for molding of an article in the mold cavity 14 and mold open positions wherein they are laterally spaced apart for discharge of the molded article.

The plasticizing-and-feeding apparatus 10 is of the injection type and comprises an elongated injection barrel 20 containing an axial, circular cross-section injection bore 22. The barrel 20 is provided with circumferential heating coils 24 arranged to heat coal and like material within the bore 22 to a temperature sufficiently great to effect its conversion to plasticized or plastic-like condition. At its forward end, the barrel 20 includes a discharge opening 26 communicating the forward end of the bore 22 with the mold cavity 14.

Adjacent to its rearward end, the bore 22 is connected to a feed conduit 32 to receive dry, solid coal and like material therefrom. The feed conduit 32 contains a normally open, shut-off valve 34 and is connected to a source 36 of the dry solid coal and like material which may be in either granular or lump form. The source 36 communicates with a source 38 of steam or hot gas through a gas supply conduit 40 to receive gas exhausted from the gas source 38 and also communicates with the gas source 38 through a gas return conduit 42, whereby the gas is returned to the gas source 38. Hence, material in the source 36 is resultantly heated prior to its supply to the apparatus 10, the extent of such pre-heating of the material being readily controllable by control of the temperature of the gas supplied into the material source 36 through the gas supply conduit 40; and, as will be understood, the temperature to which the material is so heated in the source 36 is maintained lower than the temperature necessary for conversion of the solid material into plasticized or plastic-like condition.

The bore 22 contains an injection ram or screw conveyor 44 which could contain internal heater means (not shown) for assisting in the heating of material in the barrel 20 to plastic-like condition. Ram or screw conveyor 44 is a novel element in that it is provided to function both as a conventional worm or screw conveyor, and as a conventional injection ram. Accordingly, it is formed with a screw-shaped or helical flight, to effect feed (as a screw conveyor) through its rotation, and is axially movable, to effect material injection (as an injection ram). The rearward end of the ram or screw conveyor 44 projects from the bore 20 and is connected to a carriage, designated generally as 46, such that the ram or screw conveyor 44 is axially movable conjointly with, and rotatable relative to, the carriage 46. The carriage 46 carries a conventional hydraulically operated rotary motor 48 connected to the ram or screw conveyor 44 by suitable conventional gearing 50 to rotatably drive the ram or screw conveyor 44. The carriage 46 is slidably mounted on tie rods 52 for axial movement towards-and-away from the barrel 20 and is axially driven towards the barrel 20 by a hydraulic actuator, designated generally as 54, the actuator 54 including a piston 56 connected to the carriage 46 for movement therewith and a stationary cylinder 58.

The practice of the methods of the invention through the employment of the beforedescribed apparatus, for the molding of coal proceeds as follows. First, assuming the ram or screw conveyor 44 to be at its most rearwardly position, the rotary motor 48 is actuated to rotatably drive the ram or screw conveyor 44 through the gearing 50 while dry, solid coal in either granular or lump form, and pre-heated to a temperature below that necessary to convert it to plasticized or plastic-like condition, is supplied from the source 36 to the bore 22 through the feed conduit 32. The thus supplied coal is further heated in the bore 22 to a temperature (for example, at least in the range of 750°to 800° F.) at which the coal becomes converted to plastic-like condition as it is driven by the rotation of the ram or screw conveyor 44 towards the discharge opening 30, while such coal packs around the ram or screw conveyor 44 to effectively seal therearound. The driven rotation of the ram or screw conveyor 44 conveys the coal in such plastic-like condition to the portion of the bore 22 forwardly of the forward end of the ram or screw conveyor 44 where, as the mold cavity 14 contains the article molded during the preceding operating cycle, the coal in plastic-like condition remains. After the volume of such coal in the bore 22 forwardly of the ram or screw conveyor 44 fills the then available space in the bore 22, the further plastic-like coal supplied forwardly of the ram or screw conveyor 44 axially displaces or rearwardly drives the ram or screw conveyor 44 away from the discharge opening 26. After the ram or screw conveyor 44 has been so rearwardly driven a distance controlled in a conventional manner, the ram rotation is stopped. The mold 12 is opened and the article molded during the preceding cycle is discharged from the mold cavity 14. Then, the mold 12 is closed; and hydraulic fluid is supplied to the cylinder 58 for forwardly driving the ram towards the discharge opening 26. This forward driven movement of the ram or screw conveyor 44 drives the coal in plastic-like condition from the bore 22 into the mold cavity 14 of the closed mold 12 where the coal is molded into the configuration of the article dictated by the cavity 14; and the thus formed article is discharged in the described manner during the succeeding operating cycle. Cyclically, the operation of the apparatus proceeds in this described manner.

The practice of the methods of the invention for the molding of the other mentioned materials included in the definition of the term coal and like material is similar to that beforedescribed for the molding of coal and, hence, believed to be apparent from the beforegoing description.

From the preceding description, it will be seen that, in accordance with the invention, coal and like material may be converted from solid to plastic-like or plasticized condition solely by the application of heat and without the necessity for any additives. It will be understood, however, that the coal and like material could be supplied to the bore 22 intermixed with additives — such as plastic pellets and/or color — for imparting desired physical characteristics to the article molded from the coal and like material.

From the preceding description it will be seen that the invention provides new and improved methods for accomplishing all of the beforestated objects and advantages. It will be understood, however, that although only a single embodiment of the invention has been illustrated and hereinbefore specifically described, the invention is not limited merely to this single embodiment, but rather contemplates other embodiments and variations within the scope of the following claims.

Having thus described our invention, we claim:

1. A method for molding coal and like firm brittle material which can be converted to a plastic-like substance through the application of heat, comprising the steps of providing the material in a solid form, supplying said material in such solid form into an injection bore which includes a discharge opening for discharging material to a mold, heating said supplied material in said injection bore to a temperature sufficiently great to convert the material from solid form to plastic-like condition while rotatably driving a screw conveyor in said injection bore to convey the material in plastic-like condition through said injection bore to a space adjacent to said discharge opening, accumulating said material in plastic-like condition in said space into an axially-growing mass, and axially displacing said screw conveyor by said growing mass to cause said screw conveyor to be moved away from said discharge opening for a controlled distance, then axially driving said screw conveyor towards said discharge opening to drive such accumulated material in plastic-like condition through said discharge opening into the mold cavity of a closed multi-part mold, molding the material in plastic-like condition into an article in said mold cavity and thereafter opening said multi-part mold and discharging the molded article from said mold cavity, and cyclically repeating the beforegoing steps to thereby successively form molded articles.

2. A method for molding coal and like material, according to claim 1, wherein said solid-form material is, prior to its said supply to said injection bore, preheated by hot gaseous fluid supplied from a source thereof, and said fluid is returned to its said source after its use for such preheating.

* * * * *